United States Patent [19]

Laporte

[11] 4,351,245

[45] Sep. 28, 1982

[54] COUNTERWEIGHT SYSTEM

[76] Inventor: Joseph L. Laporte, 420 E. Principale St., St.-Ambroise-de-Kildare, Quebec, Canada, J0K 1C0

[21] Appl. No.: 184,039

[22] Filed: Sep. 4, 1980

[51] Int. Cl.[3] ..... A47B 9/02

[52] U.S. Cl. ..... 108/136; 108/144; 108/2; 248/571

[58] Field of Search ..... 108/136, 2, 4, 144; 248/364, 572, 571

[56] References Cited

U.S. PATENT DOCUMENTS

| | | | |
|---|---|---|---|
| Re. 28,767 | 4/1976 | Kuhlmann | 108/2 |
| 2,168,209 | 8/1939 | Haupt | 248/572 |
| 2,924,411 | 2/1960 | Rouverol | 248/572 |
| 3,273,517 | 9/1966 | Amthor et al. | 108/2 |
| 3,283,731 | 11/1966 | Maslow | 108/136 |
| 3,370,556 | 2/1968 | Kooi | 108/136 |
| 4,130,069 | 12/1978 | Evans | 108/136 |

FOREIGN PATENT DOCUMENTS

| | | | |
|---|---|---|---|
| 468621 | 10/1950 | Canada . | |
| 1014215 | 7/1977 | Canada . | |
| 1065001 | 10/1979 | Canada . | |
| 1611809 | 8/1973 | Fed. Rep. of Germany | 108/136 |
| 474008 | 10/1937 | United Kingdom | 248/571 |
| 943344 | 12/1963 | United Kingdom | 248/571 |

*Primary Examiner*—Francis K. Zugel

[57] ABSTRACT

A counterweight system is disclosed, which is advantageously used for counterbalancing the table top of a vertically-adjustable drafting table. Obviously, the counterweight system could be used for other applications. When used in a drafting table of the type including a frame and a table top provided with vertical legs guided for up-and-down movement within the frame, cables are attached to the lower end of the two legs and are trained over a common pulley and attached to said pulley, which is freely rotatably mounted within the frame. A spiral-shape cam member is fixed to one side of the pulley and an additional cable which is attached to the pulley is trained over the cam member and attached at its other end to one end of tension springs, the other end of which is attached to the frame. The varying force exerted by the springs, with the change of their elongation, is compensated by the variable lever arm of the application of said force on the rotational axis of the cam member and pulley, so that the torque exerted by the springs on the pulley is substantially constant over all of the rotated positions of the cam member and pulley. Therefore, the load or table top is substantially counterbalanced by the springs at anyone of its adjusted positions.

1 Claim, 4 Drawing Figures

COUNTERWEIGHT SYSTEM

FIELD OF THE INVENTION

The present invention relates to a counterweight system and, more specifically, to a counterweight system using spring members instead of a mass to counterbalance the load. The counterweight system of the invention is particularly adaptable for use in drafting tables, in order to counterbalance the vertically-adjustable table top. Obviously, other uses are envisaged.

BACKGROUND OF THE INVENTION

U.S. Pat. No. 3,364,881 of Jan. 23, 1968 describes a drafting table in which the vertically-adjustable table top is counterbalanced by a mass. This mass must have sufficient weight and, therefore, precise manual adjustment of the table top is difficult because of the inertia of the whole system. In order to overcome this disadvantage, the same inventor obtained U.S. Pat. No. 3,370,556 dated Feb. 27, 1968, in which the counterweight is replaced by a complicated system including an arm pivoted at one end of the frame of the drafting table, a carriage movable along the arm and springs interconnecting the carriage and the frame. Such a system is expensive to manufacture and difficult to adjust so as to have a precise counterbalancing action over the entire range of vertical adjustable movement of the table top. However, this system is an improvement over U.S. Pat. No. 3,364,881, since the overall weight of the counterweight system is decreased and less inertia is encountered when manually adjusting the table top.

OBJECTS OF THE INVENTION

It is therefore an object of the present invention to provide a counterweight system having a minimum of inertia to movement and which is of simple construction and which affords exact counterbalancing in all the intended adjusted positions of a vertically-adjustable load.

It is another object of the invention to provide a counterweight system using biasing means and, more particularly, spring members, in which the force of the spring members varies with their degree of elongation, these spring members being used in combination with means to compensate the variation of said force.

Another object of the invention is to provide a counterweight system of the character described, in which the compensating means are designed in accordance with the force/elongation characteristic of the spring members being used in order to obtain a counterbalancing force on the load, which is substantially constant over the range of the adjusted vertical positions of the load.

SUMMARY OF THE INVENTION

The counterweight system of the invention is for stabilizing a load mounted for up-and-down movement on a frame and having a cam surface which is progressively distant from the rotational axis of the cam member, a flexible tie having one end attached to the cam member and trained on the cam surface, a biasing means connected between the frame and the other end of the flexible tie and biasing the latter with a force that changes with the rotation of the cam member, the varying lever arm of the point of tangential contact of said flexible tie with said cam member, at any given rotated position of said cam member within a predetermined range of such positions, compensating for the change of the biasing force exerted by the biasing means, so that the biasing torque exerted on the cam member by the biasing means is substantially constant for anyone of said rotated positions of said cam member, and transmission means between said cam member and said load, whereby the load is substantially counterbalanced by the biasing means at anyone of its vertical positions.

BRIEF DESCRIPTION OF THE DRAWINGS

In the drawings, like references indicate like elements throughout.

DETAILED DESCRIPTION OF THE INVENTION

Figure 1:
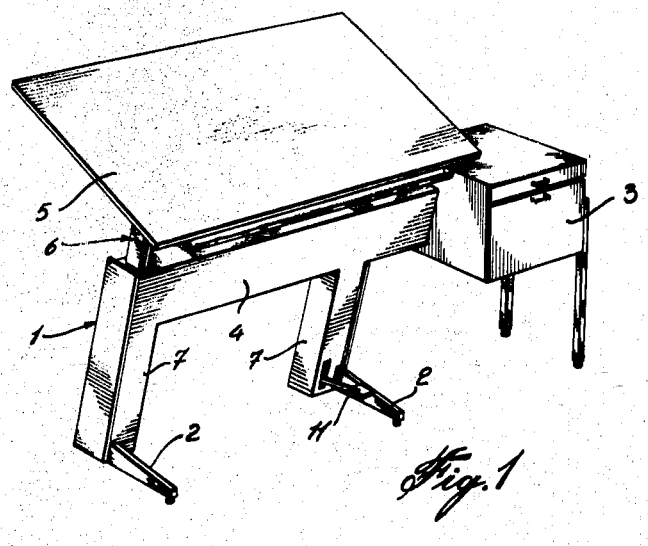
FIG. 1 is a perspective view of a drafting table with a vertically-adjustable table top, in which the counterweight of the invention is used.
Figure 2:
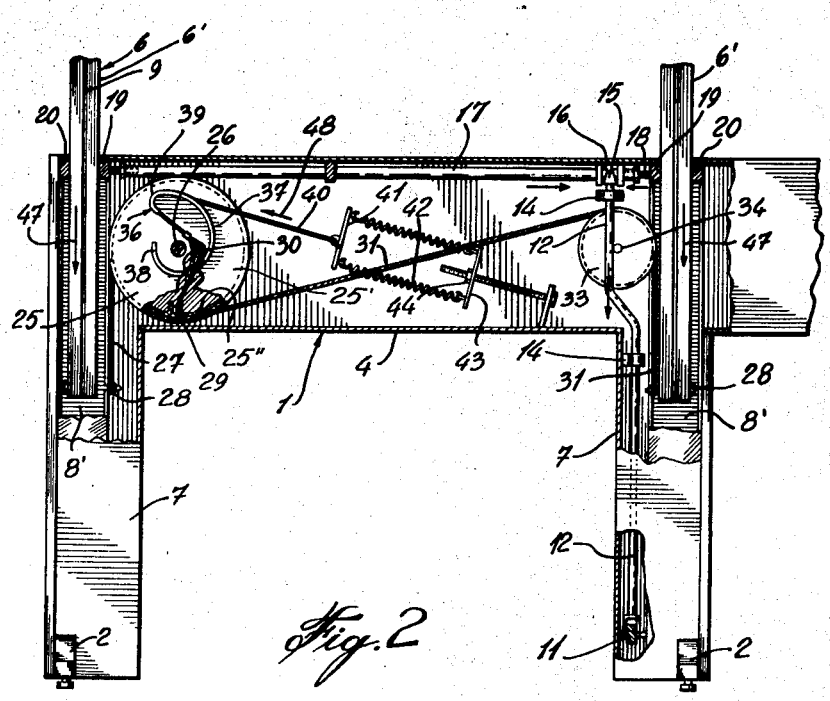
FIG. 2 is a vertical section, partially in elevation, showing part of the frame and the legs of the adjustable table top, together with the counterweight system of the invention mounted within the frame.
Figure 3:
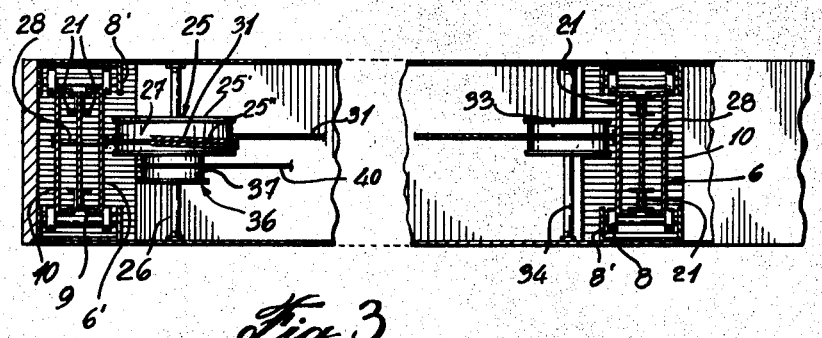
FIG. 3 is a top plan section of the frame showing the counterweight arrangement in top plan view and the table legs in cross-section.
Figure 4:
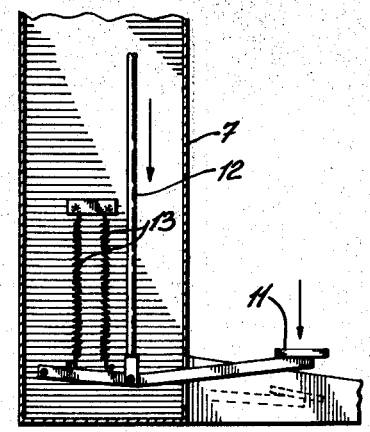
FIG. 4 is a partial vertical section of one side of the frame showing the pedal for actuating the leg-braking mechanism.

The drafting table comprises a hollow inverted U-shape frame 1 to which are rigidly secured two spaced elongated parallel feet 2 which serve to stabilize the whole drafting table with frame 1 inclined towards feet 2. A side table 3 can be fixed to the horizontal bight 4 of the U-frame. A table top 5 is provided at each end with pivoted legs 6 guided within the sides 7 of the hollow inverted U-frame 1 by means of guide rollers 8 carried by channels 8' which are secured within the sides 7, so that the table top 5 and its legs 6 can move up and down with respect to the U-shape frame 1. The table top 5 is arranged for vertical adjustment and also for adjustable tilting. The specific arrangement of the legs 6 and the means for adjusting the tilted position of the table top is exactly as in U.S. Pat. No. 3,570,556 or U.S. Pat. No. 3,364,881 above noted. Suffice to say that each leg 6 comprises a main leg 6', of rectangular cross-section, as shown in FIG. 3, and provided with a longitudinal slot 9 on each of its small sides and also a subsidiary strip-like leg 10 extending within the main leg 6'. Both the main leg 6' and the auxiliary leg 10 are pivoted about horizontal pivot axes to the underside of the table top 5, the pivot axes being spaced apart. The main leg 6' serves for the vertical adjustment of the table top, while the subsidiary leg 10 serves for tilting adjustment of the table top. When both adjustments have been effected, the foot depressed brake pedal 11, shown in FIGS. 1, 2, and 4, is released and push rod 12 moves upwardly under the bias of the tension springs 13 acting on the brake pedal 11. Push rod 12 is guided in brackets 14 (see FIG. 2) and is fitted with a wedge cam 15 at its upper end. Upon upward movement, wedge cam 15 exerts an outward force on the bevel end 16 of each brake rod 17 and 18. The latter extend in opposite directions along and within the top of the bight 4 and are provided with a brake shoe 19 at their ends, which engage the main legs 6' and compress the same against the stationary brake shoes 20 in order to positively maintain the main legs 6' against vertical movement. At the same time, auxiliary brake shoes 20 carried by the two halves of main legs 6' apply a braking force on the subsidiary central leg 10, to therefore lock the table top in adjusted tilted position. This braking mechanism is very similar to the braking mechanism described in U.S. Pat. No. 3,364,881 above noted.

The present invention is directed to the counterweight system per se and to this counterweight system when used in conjunction with the above described drafting table.

The load consisting of the table top 5 and the leg assemblies 6 must be counterbalanced for ease in the manual vertical adjustment of the table top. The counterweight system includes a pulley 25 which is mounted for free rotation on a transverse horizontal shaft 26 extending within the bight 4 of U-frame 1 and secured to the walls thereof. Pulley 25 is of hollow construction and consists of spaced radial side walls 25' and peripheral cylindrical wall 25''. A flexible cable 27 has one end attached by pin 28 to the lower end of the left hand main leg 6', extends upwardly along said leg 6' and is trained around the top of the pulley 25 and enters through an opening 29 made in the cylindrical surface of the pulley to to be attached to and within the pulley by a tie pin 30. Tie pin 30 removably extends through the body of the pulley 25 and is close to the pivot shaft 26. Similarly, another flexible cable 31 is attached by a pin 28 to the lower end of the main leg 6' of the right hand leg assembly of the drafting table. Cable 31 extends upwardly along the right-hand main leg 6' and then is trained over idle pulley 33 which is freely rotatably mounted about a horizontal transverse pivot pin 34 within the bight 4 of the U-frame 1. Cable 31 then extends diagonally downwardly towards pulley 25 to engage the underside of said pulley and is trained a full turn around said pulley to finally enter opening 29 of the body of the pulley. Cable 31 then extends within the pulley to be finally attached to the tie pin 30 as is flexible cable 27.

A cam member 36 is fixed to one side of the main pulley 25. Cam member 36 has a spiral shape cam surface 37; surface 37 is progressively distant from pivot shaft 26, starting from a radially inner point 38 to a radially outer end point 39. From point 39, the cam surface 37 is bent radially inwardly along a sharp curve 39'. A third cable 40 has one end attached to tie pin 30 then is trained around the curved outer end 39' of the cam surface, then is trained onto the cam surface 37, then extends freely while its outer end is attached through the intermediary of a head plate 41 to one end of a series of parallel tension springs 42, the other end of each of said tension springs being attached to a head plate 43 itself adjustably connected to the frame 1 by means of a nut 44 and a bolt 45 and a bracket 46. The bracket 46 is welded or otherwise secured inside the bight 4 of the frame 1 and has a hole for receiving the bolt 45, the head of which abuts the bracket. The nut 44 can be rotated on bolt 45 to adjust the initial tension of the springs.

In the arrangement shown, when the table legs 6 are moved downwardly as indicated by arrows 47, cables 27 and 31 cause anti-clockwise rotation of the main pulley 125 and consequently of the cam member 36 attached thereto. Consequently, cable 40 is pulled in the direction of arrow 48 causing elongation of the spring members 42. Spring members 42 exert a progressively increasing resistance force which is proportional to the degree of spring elongation but this varying pulling force is compensated by the cam member 36; as the cam member 36 rotates in a counterclockwise movement, the effective lever arm of the pulling force exerted by cable 40 and which extends from the shaft 26 and is at right angles to the straight portion of the cable 40 where it first comes into tangential contact with cam surface 37. Therefore upon counterclockwise rotation of the pulley 25 and consequently of the cam member 36, the effective lever arm progressively decreases to compensate for the progressively increasing force exerted by the spring members 42 and therefore the effective torque which is the product of the lever arm by the instantaneous force exerted by the springs remains substantially constant over all the rotated positions of the cam member 36 within the range of vertical adjustment of the table top.

It should be noted that the cam surface 37 of the cam member 36 can be made to the necessary shape for compensating the force exerted by the springs in accordance with the exact characteristics of the force to elongation ratio for all elongated states of the spring members.

Preferably, all the three cables 27, 31 and 40 are attached to the common tie pin 30 which can be removed for disassembling the cables in case of repair. Tie pin 30 is located radially inwardly of cam 36.

Obviously, the counterweight system of the invention can be applied to other uses than that of counterbalancing the table top of a drafting table.

What I claim is:

1. A drafting table comprising a frame of inverted U-shaped hollow construction having a top transverse bight member and two upright sides downwardly depending from the ends of said bight member; a leg assembly including first and second legs vertically displaceable within the respective sides of said U-shaped frame and upwardly protruding through said bight member; a table top mounted on the upper ends of said first and second legs and overlying said bight member; a horizontal pivot shaft extending transversely through said bight member and mounted therein adjacent said first leg; a first pulley having a cylindrical peripheral wall close to said first leg and a pair of spaced side walls mounted on said shaft; a cam member secured to one of said side walls of said pulley; said cam member having a spiral shaped cam surface progressively distant from the rotational axis of said pivot shaft; first and second flexible ties trained in the same direction around said pulley and each having one end portion extending through said peripheral wall and within said pulley and attached to the latter by a common removable tie pin extending through said side walls of said first pulley, the peripheral wall of said first pulley guiding said first flexible tie alongside said first leg, the other end of said first flexible tie being secured to the lower end of said first leg; said second flexible tie having its other end secured to the lower end of said second leg; said second flexible tie being trained around a second pulley rotatively and transversely mounted within said bight member, spaced from said pivot shaft and located adjacent said second leg; said second pulley guiding said second flexible tie alongside said second leg, said second flexible tie extending directly from said second pulley to said first pulley within said bight member; the points of tangential contact of said first and second flexible ties with the peripheral wall of said first pulley being angularly spaced from each other around said first pulley; a third flexible tie having one end trained around said cam surface and secured to said first pulley by said common tie pin; the other end of said third flexible tie being fastened to at least one tension coil spring which in turn is secured to said frame within said bight member at the opposite end of said tension spring, whereby the increasing force exerted by said tension spring on said member as it stretches is compensated by the decreasing lever arm of the point of tangential contact of said third flexible tie on said cam surface as said cam member rotates between two limit positions so as to counterbalance said table top and legs at any adjusted position of said table top; and tension adjustment means for said tension spring, said inverted U-shaped hollow frame defining a space between said upright sides which is completely free of any obstruction.

* * * * *